US009303595B2

(12) United States Patent
Forshier

(10) Patent No.: US 9,303,595 B2
(45) Date of Patent: Apr. 5, 2016

(54) EXHAUST GAS RECIRCULATION COOLER MOUNT

(71) Applicant: DEERE & COMPANY, Moline, IL (US)

(72) Inventor: Adam Forshier, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 274 days.

(21) Appl. No.: 14/011,015

(22) Filed: Aug. 27, 2013

(65) Prior Publication Data

US 2015/0059715 A1 Mar. 5, 2015

(51) Int. Cl.

| | |
|---|---|
| ***F02B 47/08*** | (2006.01) |
| ***F02M 25/07*** | (2006.01) |
| ***F02M 55/00*** | (2006.01) |
| ***F02M 37/00*** | (2006.01) |
| ***F02M 63/02*** | (2006.01) |

(52) U.S. Cl.

CPC ..... *F02M 25/0703* (2013.01); *F02M 25/0735* (2013.01); *F02M 25/0737* (2013.01); *F02M 37/0017* (2013.01); *F02M 55/002* (2013.01); *F02M 63/0275* (2013.01); *F02M 2200/85* (2013.01)

(58) Field of Classification Search

CPC ..... F02M 25/0703; F02M 25/0735; F02M 37/0017; F02D 41/3872

USPC ..... 123/568.12, 195 A, 196 R; 164/98; 73/756

See application file for complete search history.

(56) References Cited

U.S. PATENT DOCUMENTS

| | | | | |
|---|---|---|---|---|
| 3,853,309 | A | 12/1974 | Widmer | |
| 4,267,812 | A * | 5/1981 | Aula | F02B 47/08 123/184.33 |
| 4,406,161 | A * | 9/1983 | Locke et al. | 73/114.33 |
| 4,749,624 | A * | 6/1988 | Pete | B22D 19/0072 428/586 |
| 4,832,106 | A * | 5/1989 | Bucking | F27D 9/00 164/100 |
| 5,635,305 | A * | 6/1997 | Haga | B22D 19/0072 428/577 |
| 5,740,851 | A * | 4/1998 | Haynes | B22D 19/0072 164/98 |
| 6,158,400 | A | 12/2000 | Collie et al. | |
| 6,513,507 | B2 | 2/2003 | Balekai et al. | |
| 6,935,321 | B1 * | 8/2005 | Sullivan | F02M 35/10222 123/568.17 |
| 7,387,102 | B2 | 6/2008 | Henkel | |
| 7,428,894 | B2 * | 9/2008 | Kikutani et al. | 123/506 |

(Continued)

FOREIGN PATENT DOCUMENTS

| | | |
|---|---|---|
| DE | 10119484 A1 | 10/2002 |
| EP | 1643097 A1 | 4/2006 |
| FR | 2928178 A1 | 9/2009 |

OTHER PUBLICATIONS

European Search Report issued in counterpart application No. 14181768.4, dated Feb. 12, 2015 (5 pages).

*Primary Examiner* — Marguerite McMahon
*Assistant Examiner* — James Kim

(57) ABSTRACT

An EGR cooler mount comprising an inlet port, an outlet port positioned downstream of the inlet port, and a leak off passage. The inlet port is configured to receive fuel, and the outlet port is configured to distribute the fuel to a fuel tank. The leak passage is positioned fluidly between the inlet port and the outlet port, and is positioned in the EGR cooler mount.

18 Claims, 6 Drawing Sheets

(56) References Cited

U.S. PATENT DOCUMENTS 7,810,466 B2 * 10/2010 Preimesberger ..... F02B 67/10 123/184.31
8,056,545 B2 * 11/2011 Feist ..... F02M 25/0732 123/195 C
8,176,967 B2 5/2012 Henkel et al.
8,201,457 B1 * 6/2012 Halilah ..... 73/756
8,770,177 B2 * 7/2014 Krgo ..... F02M 25/0737 123/568.12
8,820,297 B2 * 9/2014 Iwatani ..... 123/348
2002/0014225 A1 * 2/2002 Ushigome ..... 123/509

* cited by examiner

EXHAUST GAS RECIRCULATION COOLER MOUNT

FIELD OF THE DISCLOSURE

The present disclosure relates to an exhaust gas recirculation ("EGR") cooler mount. More specifically, the present disclosure relates to an EGR mount comprising a leak off passage.

BACKGROUND OF THE DISCLOSURE

All engines—diesel, gasoline, propane, and natural gas—produce exhaust gas containing carbon monoxide, hydrocarbons, and nitrogen oxides. These emissions are the result of incomplete combustion. Diesel engines also produce particulate matter. As more government focus is being placed on health and environmental issues, agencies around the world are enacting more stringent emission's laws.

Because so many diesel engines are used in trucks, the U.S. Environmental Protection Agency and its counterparts in Europe and Japan first focused on setting emissions regulations for the on-road market. While the worldwide regulation of nonroad diesel engines came later, the pace of cleanup and rate of improvement has been more aggressive for nonroad engines than for on-road engines. Manufacturers of nonroad diesel engines are expected to meet set emissions regulations. For example, Tier 3 emissions regulations required an approximate 65 percent reduction in particulate matter (PM) and a 60 percent reduction in $NO_x$ from 1996 levels. As a further example, Interim Tier 4 regulations required a 90 percent reduction in PM along with a 50 percent drop in $NO_x$. Still further, Final Tier 4 regulations, which will be fully implemented by 2015, will take PM and $NO_x$ emissions to near-zero levels.

One known technique for reducing unwanted $NO_x$ involves introducing chemically inert gases into the fresh air flow stream for subsequent combustion. By reducing the oxygen concentration of the resulting charge to be combusted, the fuel burns slower and peak combustion temperatures are accordingly reduced, thereby lowering the production of $NO_x$. In an internal combustion engine environment, such chemically inert gases are readily abundant in the form of exhaust gases, and one known method for achieving the foregoing result is through the use of an EGR system operable to controllably introduce (i.e., recirculate) exhaust gas from the exhaust manifold into the fresh air stream flowing to an intake manifold. Known EGR systems comprise EGR coolers, and the EGR coolers require a secure mounting location.

SUMMARY OF THE DISCLOSURE

An EGR cooler mount comprising an inlet port, an outlet port positioned downstream of the inlet port, and a leak off passage. The inlet port is configured to receive fuel, and the outlet port is configured to distribute the fuel to a fuel tank. The leak off passage is positioned fluidly between the inlet port and the outlet port.

BRIEF DESCRIPTION OF THE DRAWINGS

The detailed description of the drawings refers to the accompanying figures in which.

DETAILED DESCRIPTION OF THE DRAWINGS

Figure 1:
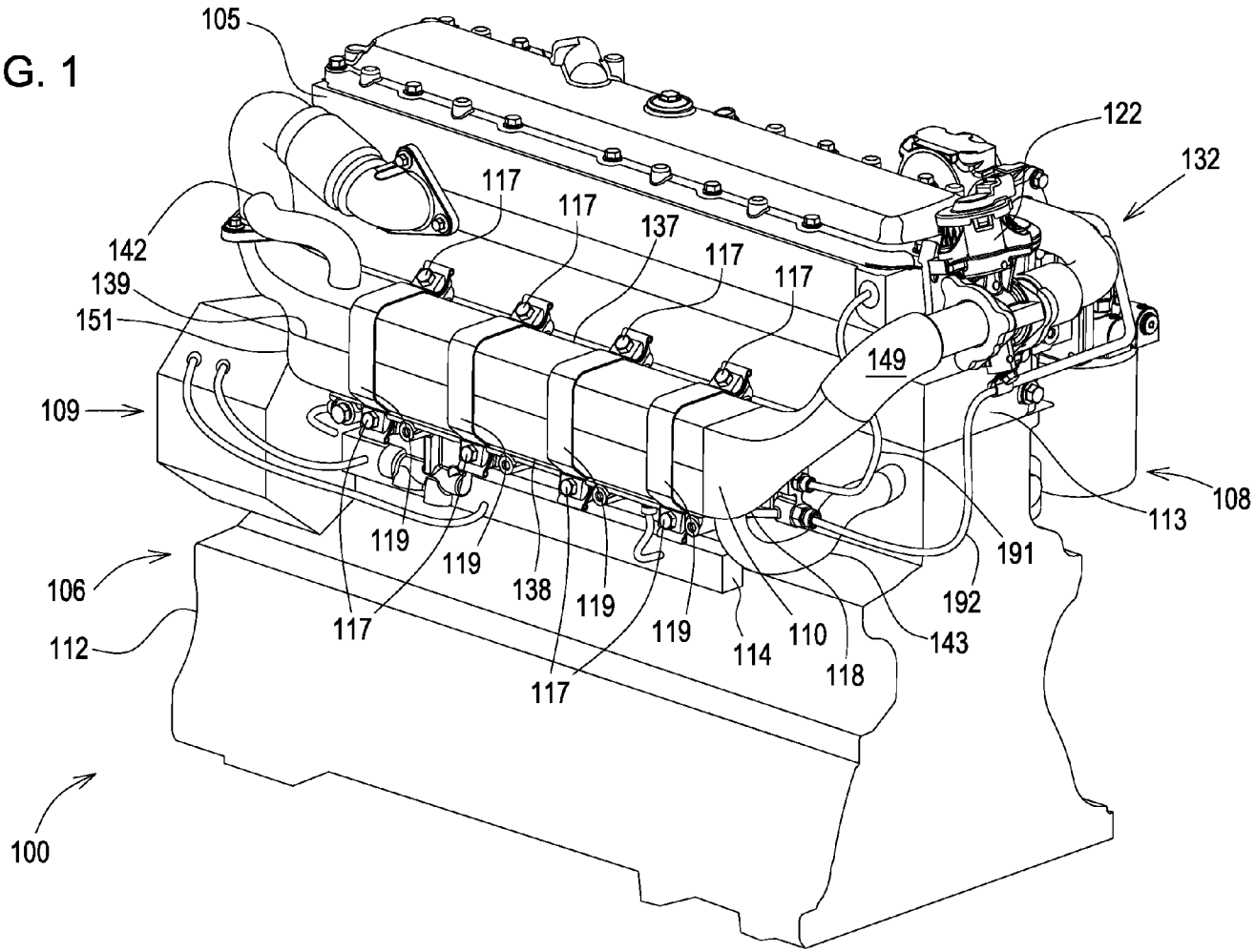
FIG. 1. is a perspective view of a power system comprising an EGR cooler and an embodiment of an EGR cooler mount.
Figure 2:
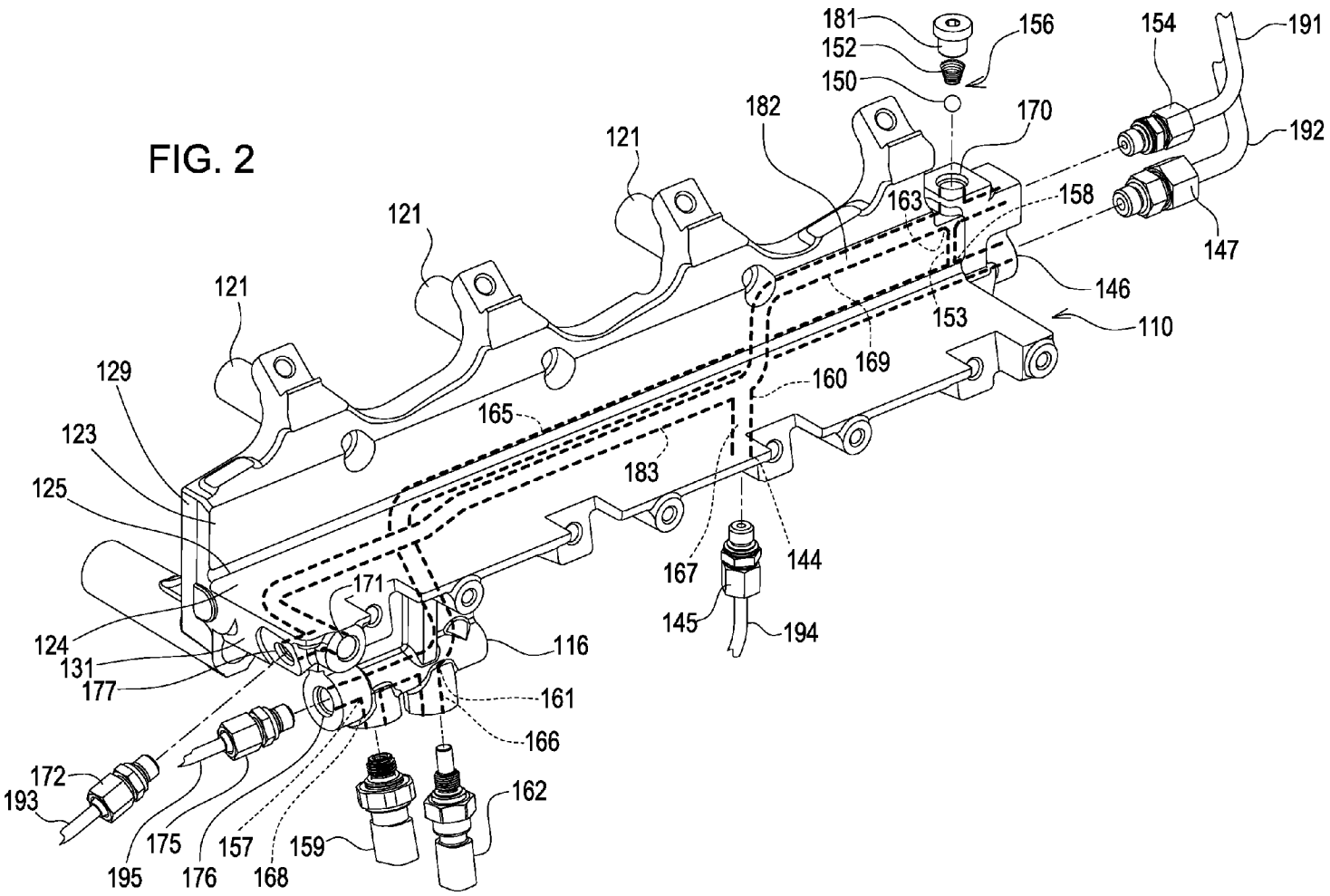
FIG. 2 is the perspective view of the EGR cooler mount of FIG. 1 showing (in phantom) a leak off passage, a fuel supply passage, a rail leak off passage, and an air bypass passage.
Figure 3:
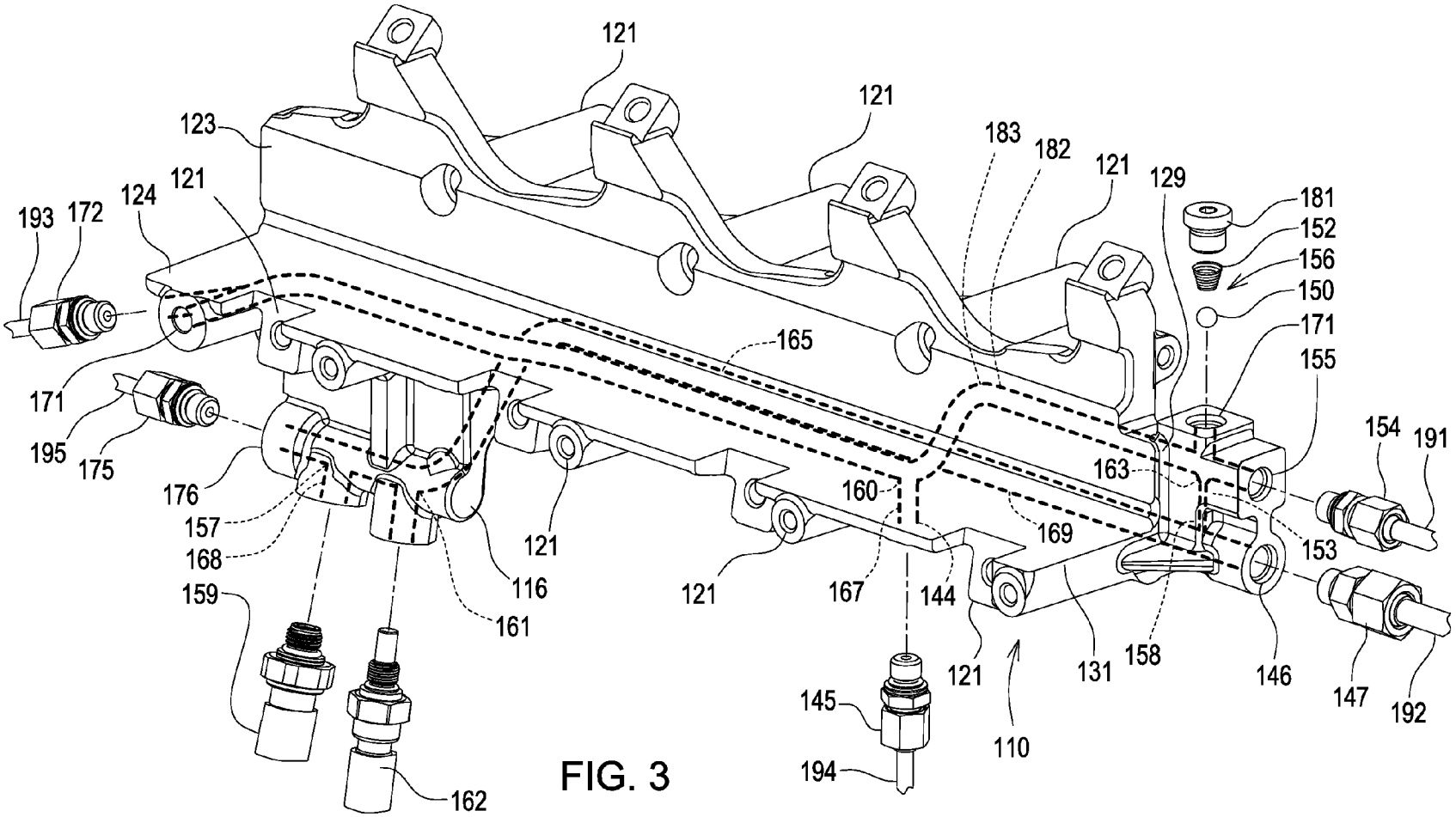
FIG. 3 is an alternative, perspective view of the EGR cooler mount showing (in phantom) the leak off passage, the fuel supply passage, the rail leak off passage, and the air bypass passage.
Figure 4:
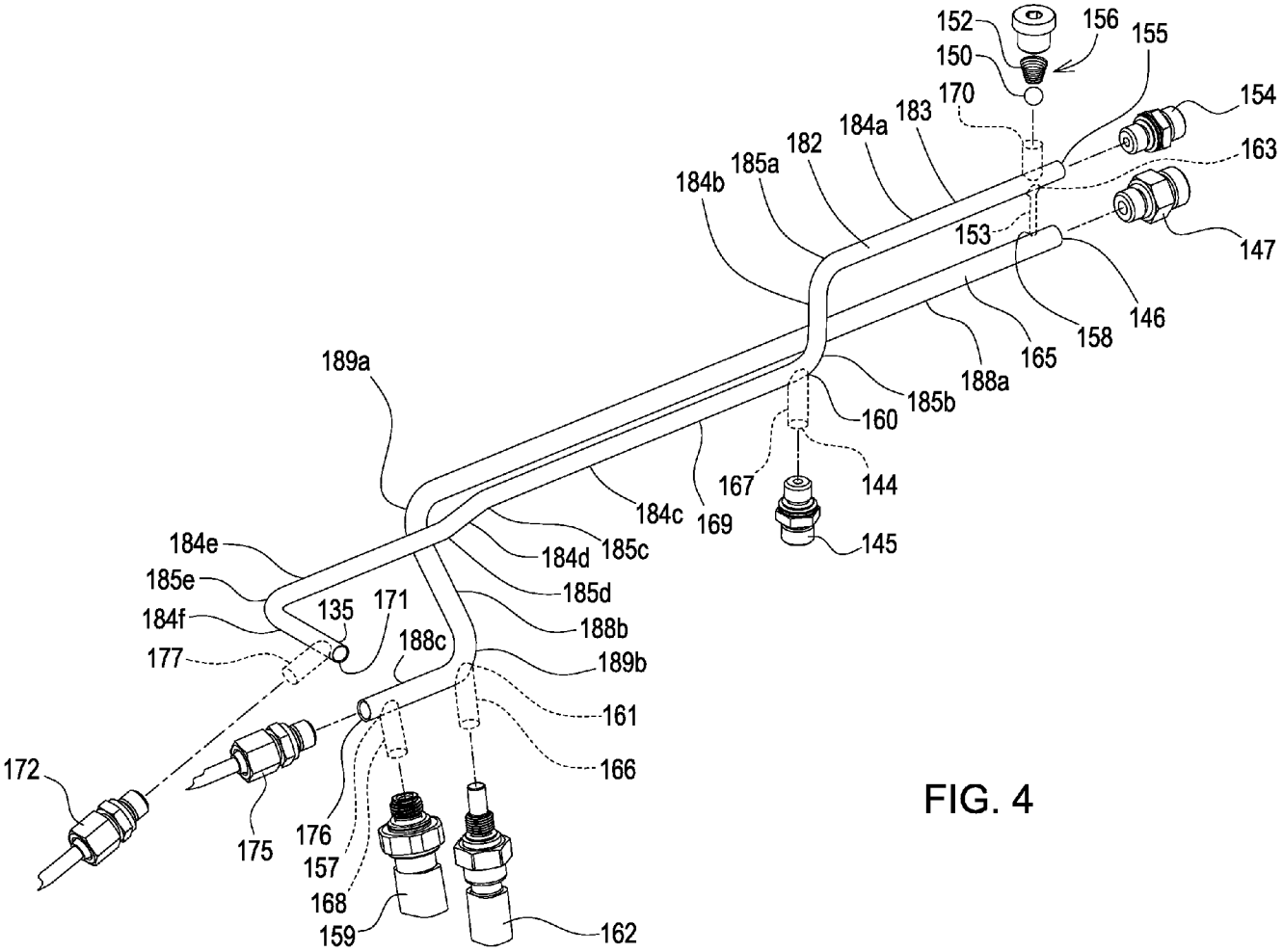
FIG. 4 is a view—without the EGR cooler mount—of the leak off passage, the fuel supply passage, the rail leak off passage (in phantom), and the air bypass passage (in phantom)
Figure 5:
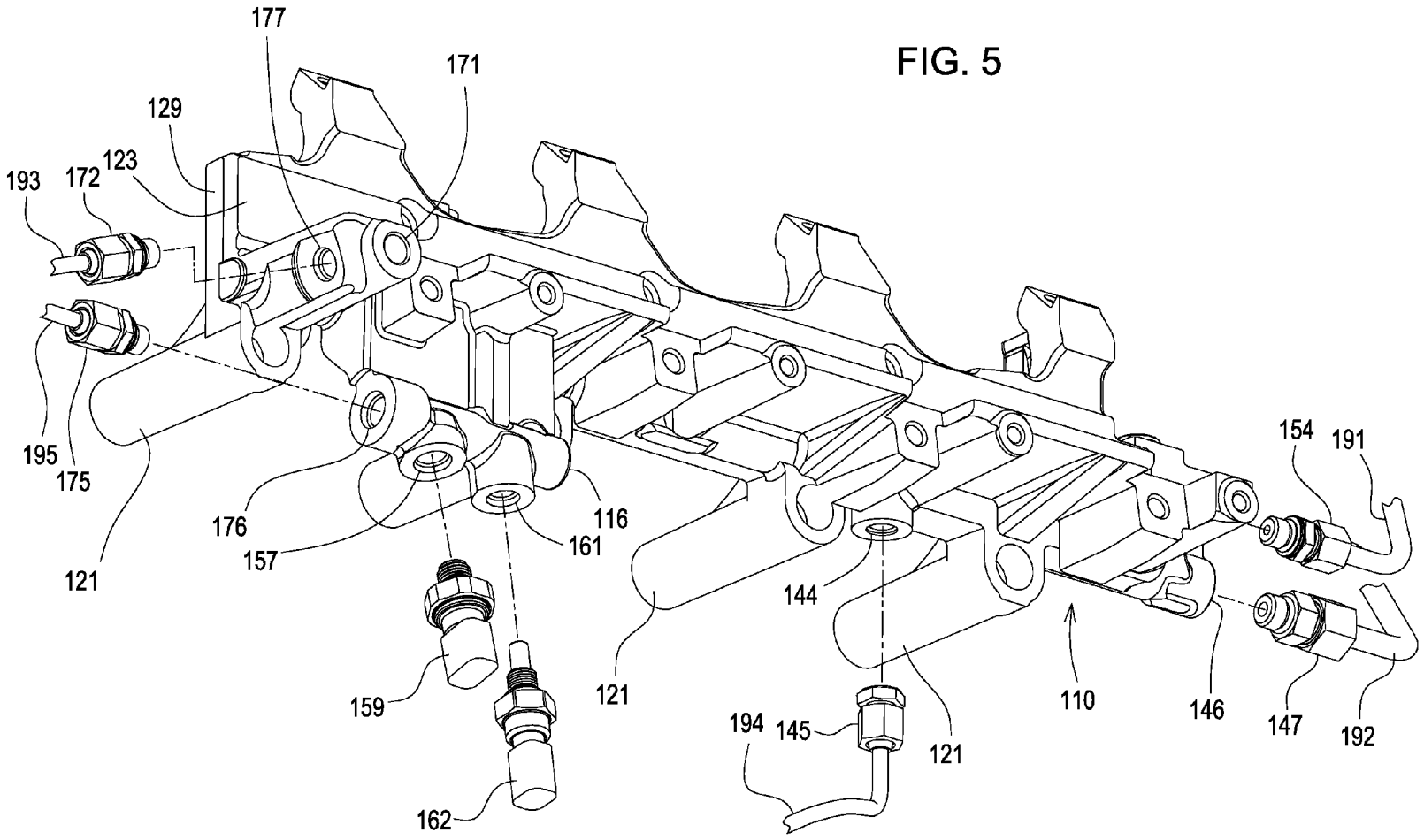
FIG. 5 is a perspective view of a bottom of the EGR cooler mount.
Figure 6:
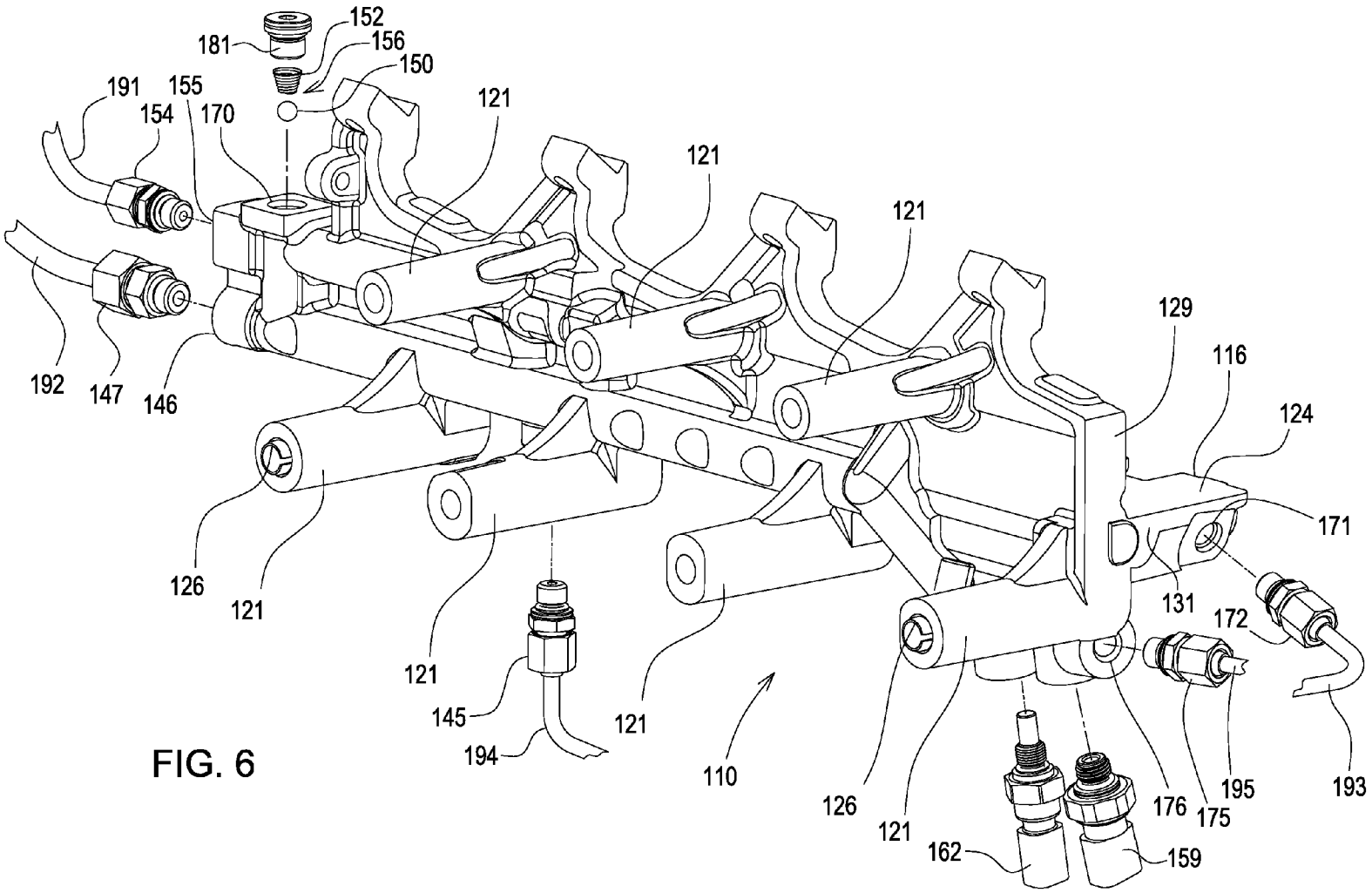
FIG. 6 is an alternative perspective view of the back EGR cooler mount.

Referring to FIG. 1, there is shown a power system 100 that comprises an EGR cooler mount 110, an EGR cooler 118, and a plurality of straps 119 positioned about the EGR cooler 118 for securing the EGR cooler 118 to the EGR cooler mount 110. The power system 100 may be used for providing power to a variety of machines, including on-highway trucks, construction vehicles, marine vessels, stationary generators, automobiles, agricultural vehicles, and recreational vehicles. The power system 100 comprises an engine 106, and the EGR cooler mount 110 may be secured to the engine 106. The engine 106 may be any kind of engine 106 that produces an exhaust gas, such as a gasoline engine, a diesel engine, a gaseous fuel burning engine (e.g., natural gas), or any other exhaust gas producing engine. The engine 106 may be of any size, with any number cylinders (not shown), and in any configuration (e.g., "V," inline, and radial).

The EGR cooler mount 110 may be mounted to at least one of an engine block 112 and an engine head 113, via a plurality of mounting posts 121 and cooler mounting fasteners (not shown), the cooler mounting fasteners being, for example, socket head cap screws. As illustrated, spring pins 126 may be used for positioning and an aligning the EGR cooler mount 110 during installation. As shown, the EGR cooler mount 110 may comprise other, additional mounting features and apertures, so that tubes, sensors, wiring harness, aftertreatment devices, and the like can be mounted thereto.

The number of straps 119 used in a given application (i.e., one or more) may depend on the length and weight of the EGR cooler 118. Although the straps 119 are shown as smooth straps, they may take other forms, such as corrugated straps. The EGR cooler 118 is configured to cool the exhaust gas, the exhaust gas being rerouted to the intake system (not shown) so as to reduce $NO_x$ levels in the exhaust gas entering the atmosphere.

Exhaust gas from the engine 106 may enter the EGR cooler 118, via an exhaust gas inlet 151, and the exhaust gas may then exit the EGR cooler 118, via an exhaust gas outlet 149, and be rerouted back to the engine 106. Engine coolant may enter the EGR cooler 118 via a coolant inlet 143, and it may exit the EGR cooler 118 via a coolant outlet 142. The exhaust gas transfers heat to the engine coolant. In the embodiment shown, the exhaust gas flow direction is counter to the engine coolant flow direction, though in other embodiments of the power system 100, they could flow in the same direction relative to one another.

The EGR cooler 118 may comprise a first piece 137, a second piece 138, and a welded joint 139, wherein welded joint 139 may join the first piece 137 and the second piece 138. The welded joint 139 may be an overlapping joint.

Exemplarily, the first piece 137 and the second piece 138 may be made of stainless steel (or various other kinds of ferrous materials). In the illustrated embodiment, the first piece 137 is shown as a lower piece, and the second piece 138 is shown as an upper piece. In other embodiments, however, the first piece 137 and the second piece 138 may be oriented differently, such as, for example, side-by-side to one another. Additionally, in some embodiments, the EGR cooler 118 may comprise a separate inlet casting and a separate outlet casting, both of which may be made of stainless steel (or various other kinds of ferrous materials). The straps 119 may be made of, for example, 1008 steel, 1020 steel, stainless steel (or various other kinds of ferrous materials). The EGR cooler mount 110—which may be made of, for example, cast iron—may comprise a first mounting face 123 and a second mounting face 124. A plurality of fasteners 117 and may secure the straps 119 to the EGR cooler mount 110.

The EGR cooler mount 110 may comprise an inlet port 155, an outlet port 171, and a leak off passage 182. An inlet port fitting 154 may be positioned in the inlet port 155, the inlet port fitting 154 being, for example, a line nut that cooperates with a fitting installed in the EGR cooler mount 110, so as to form an o-ring face seal connection. As shown, a tube 191 may be fluidly coupled to—and positioned upstream of—the inlet port fitting 154, and it may also be fluidly coupled to a valve train carrier 105, so that it may receive fuel that leaks off from the fuel injectors (not shown) and provide it to the inlet port 155. The outlet port 171 is positioned downstream of the inlet port 155, the outlet port 171 being configured, for example, to distribute the fuel to a fuel tank (not shown).

An inlet port fitting 172 may be positioned in a pump leak inlet port 177, wherein the inlet port fitting 172 may be a line nut that cooperates with the EGR cooler mount 110 so as to form an o-ring face seal connection. A tube 193 may be fluidly coupled to, and positioned downstream of, the inlet port fitting 172, and it may also be fluidly coupled to—and positioned downstream of—a high pressure fuel pump of the high pressure fuel system 109.

The leak off passage 182 is positioned fluidly between the inlet port 155 and the outlet port 171, and may be formed by a leak off passage tube 183. The leak off passage tube 183 may be made of steel and cast into position—using, for example, a lost foam casting process—so as to potentially eliminate machining operations, cycle times, and leak paths.

The EGR cooler mount 110 may comprise a rail leak off passage 167 and a rail leak inlet port 144, the rail leak inlet port 144 being configured to receive leak off fuel from a common fuel rail 114. The leak off passage 182 comprises a rail leak outlet port 160 that is positioned downstream of the rail leak inlet port 144. The rail leak off passage 167 extends fluidly between the rail leak inlet port 144 and the rail leak off outlet port 160.

A rail leak off fitting 145 may be positioned in the rail leak inlet port 144, and may be, for example, a line nut that cooperates with the EGR cooler mount 110 so as to form an o-ring face seal connection. As illustrated, the rail leak off passage 167 may be a cross drilled passage. A tube 194 may be fluidly coupled to—and positioned upstream of—the rail leak off fitting 145, so as to receive fuel that leaks off from the common fuel rail 114.

The EGR cooler mount 110 may comprise a fuel passage inlet port 146, a fuel passage outlet port 176, and a fuel supply passage 165. A fuel passage outlet fitting 175 may be positioned in the fuel passage outlet port 176, and the fuel passage outlet fitting 175 may be a line nut that cooperates with the EGR cooler mount 110 so as to form an o-ring face seal connection. A tube 195 may be fluidly coupled to, and positioned downstream of, the fuel passage outlet fitting 175.

A fuel passage inlet fitting 147 may be positioned in the fuel passage inlet port 146, and the fuel passage inlet fitting 147 may be a line nut that cooperates with the EGR cooler mount 110 so as to form an o-ring face seal connection. As shown, a tube 192 may be fluidly coupled to—and be positioned upstream of—the fuel passage inlet fitting 147. The fuel passage outlet port 176 may be positioned downstream of the fuel passage inlet port 146. The fuel passage inlet port 146 may be configured to receive fuel from, for example, a low pressure fuel system 108, and the fuel passage outlet port 176 may be configured to deliver fuel to, for example, a high pressure fuel system 109 that then delivers the fuel to be combusted in the engine 106.

The fuel supply passage 165 may be positioned fluidly between the fuel passage inlet port 146 and the fuel passage outlet port 176. As shown, the fuel supply passage 165 may be "L-shaped," but it may take other shapes as appropriate in a given application. The fuel supply passage 165 may be made of steel and cast into position—using, for example, a lost foam casting process—so as to potentially eliminate machining operations, cycle times, and leak paths.

The fuel supply passage 165 may comprise a pressure sensor port 157 and a temperature sensor port 161, the pressure sensor port 157 and the temperature sensor port 161 being positioned, in the illustrated embodiment, in series relative to one another. A pressure sensor 159 may be positioned in the pressure sensor port 157, and a temperature sensor 162 may be positioned in the temperature sensor port 161. As shown, a cross drilled temperature sensor passage 166 may open into the temperature sensor port 161, and a cross drilled pressure sensor passage 168 may open into the pressure sensor port 157. The pressure sensor port 157 may be positioned downstream of the temperature sensor port 161, and the fuel passage outlet port 176, downstream of the pressure sensor port 157.

The EGR cooler mount 110 may further comprise a substantially vertical wall 129 and a substantially horizontal wall 131, so that the straps 119 may apply a clamp force about the EGR cooler 118, thereby forcing it towards both the substantially vertical wall 129 and the substantially horizontal wall 131. The substantially vertical wall 129 and the substantially horizontal wall 131 may form a mount edge 125. The pressure sensor port 157 and the temperature sensor port 161 may both be positioned in a sensor mount 116, the sensor mount 116 extending from the substantially horizontal wall 131. As illustrated, the fuel supply passage 165 may be positioned in a combination of the substantially horizontal wall 131 and the sensor mount 116, though it may be positioned anywhere in the EGR cooler mount 110, depending on the particular application.

The fuel supply passage 165 may comprise an air bypass outlet port 158, and the leak off passage 182 may comprise an air bypass inlet port 163. An air bypass passage 153 may be positioned fluidly between the air bypass outlet port 158 and the air bypass inlet port 163. The rail leak outlet port 160 may be positioned downstream of the air bypass inlet port 163. As illustrated, the air bypass outlet port 158 may be a drilled opening in the fuel supply passage 165, and the air bypass outlet port 158 and the air bypass inlet port 163 may be coaxially aligned, as a result of being part of the a cross drilled passage.

An air bleed check valve 156 may be configured to block communication (e.g., air and fuel), between the air bypass passage 153 and the leak off passage 182, when in a closed position, but configured to allow communication, between the same components, when in an open position. The air bleed check valve 156 may be open in a direction away from the fuel supply passage 165 and towards the leak off passage 182, or more specifically, the air bleed check valve 156 may be configured to open if there is any air upstream thereof in the fuel supply passage 165. Air may be present in the fuel supply passage 165 following assembly and/or maintenance to the power system 100.

The air bleed check valve 156 may be a check valve that, for example, comprises a ball 150 and a spring 152, the ball 150 being sandwiched between the spring 152 and the air bypass inlet port 163. Although the air bleed check valve 156 is shown as a ball check valve, in other embodiments, the air bleed check valve 156 may be—for example—a diaphragm check valve, a swing check valve, or a stop check valve. An outer diameter of the ball 150 may be greater than in inner diameter of the air bypass inlet port 163. In such an embodiment, the spring 152 and the ball 150 and the air bypass passage 153 may all be coaxially aligned relative to one another.

Although not shown, the air bleed check valve 156 may be positioned in the air bypass passage 153. In such an embodiment, the air bleed check valve 156 may be configured to block communication (e.g., air and fluid), between the fuel supply passage 165 and the leak off passage 182, when in a closed position, but configured to allow communication when in an opened position.

In the embodiment shown, the leak off passage 182 comprises first through sixth segments 184*a*-184*f*, and bends 185*a*-185*e* separate each of the segments 184*a*-184*f*. The first and second segments 184*a*, 184*b* may be positioned in the substantially vertical wall 129, while the third through sixth segments 184*c*-184*f* may be positioned in the substantially horizontal wall 131. The third segment 184*c* may overlap the mount edge 125. Further, the inlet port 155 and the air bypass inlet port 163 may be positioned in the first segment 184*a*; rail leak outlet port 160, in the third segment 184*c*; and the outlet port 171, in the sixth segment 184*f*.

Further, in the embodiment shown, the fuel supply passage 165 comprises first through third segments 188*a*-188*c*, and bends 189*a*, 189*b* may be positioned between each of the segments 188*a*-188*c*. The first segment 188*a* and the third segments 188*c* may be positioned in parallel with respect to one another and with the mount edge 125, while the second segment 188*b* may be positioned perpendicularly with respect to the first segment 188*a* and the third segment 188*c* and the mount edge 125. The second segment 188*b* and the third segments 188*c* may be positioned in the sensor mount 116. The fuel passage inlet port 146 may be positioned in the first segment 188*a*, and the pressure sensor port 157 and the temperature sensor port 161 and the fuel passage outlet port 176 are all positioned in the third segment 188*c*.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. An exhaust gas recirculation ("EGR") cooler mount, comprising:

a leak off passage being positioned in the EGR cooler mount and extending fluidly between an inlet port and an outlet port, the inlet port being configured to receive fuel, the outlet port being positioned downstream of the inlet port, the outlet port being configured to distribute the fuel;

a fuel supply passage being positioned in the EGR cooler mount and extending fluidly between a fuel passage inlet port and a fuel passage outlet port, the fuel passage inlet port being positioned upstream of the fuel passage outlet port, the fuel passage inlet port being configured to receive the fuel, the fuel passage outlet port being configured to provide the fuel to be combusted in an engine;

an air bypass passage being positioned in the EGR cooler mount and extending fluidly between an air bypass inlet port and an air bypass outlet port, the air bypass inlet port being positioned upstream of the air bypass outlet port, the air bypass inlet port opening in from the fuel supply passage, the air bypass outlet port opening out into the leak off passage; and an air bleed check valve, when in a closed position, being positioned against the air bypass inlet port and being configured to block communication between the air bypass passage and the leak off passage, and the air bleed check valve, when in an opened position, being positioned away from the air bypass inlet port and being configured to allow communication between the air bypass passage and the leak off passage.

2. The EGR cooler mount of claim 1, wherein the leak off passage is formed by a leak off passage tube that is cast into position in the EGR cooler mount.

3. The EGR cooler mount of claim 1, further comprising a rail leak off passage being positioned in the EGR cooler mount and extending fluidly between a rail leak inlet port and a rail leak outlet port, the rail leak inlet port being positioned upstream of the rail leak outlet port, the rail leak inlet port being configured to receive leak off fuel from a common fuel rail, and the rail leak outlet port opening out into the leak off passage.

4. The EGR cooler mount of claim 3, wherein the rail leak off passage is a cross drilled passage in the EGR cooler mount.

5. The EGR cooler mount of claim 1, wherein the fuel supply passage is formed by a fuel supply passage tube that is cast into position in the EGR cooler mount.

6. The EGR cooler mount of claim 1, wherein the fuel supply passage further comprises a pressure sensor port and a temperature sensor port.

7. The EGR cooler mount of claim 6, wherein the pressure sensor port and the temperature sensor port are positioned in series relative to one another.

8. The EGR cooler mount of claim 6, wherein the temperature sensor port is positioned upstream of the pressure sensor port.

9. The EGR cooler mount of claim 6, wherein the fuel passage outlet port and the pressure sensor port are positioned in series relative to one another.

10. The EGR cooler mount of claim 6, wherein the pressure sensor port is positioned upstream of the fuel passage outlet port.

11. The EGR cooler mount of claim 6, further comprising a wall and a sensor mount extending from the wall, the pressure sensor port and the temperature sensor port being positioned in the sensor mount.

12. The EGR cooler mount of claim 11, wherein the fuel supply passage is positioned in a combination of the wall and the sensor mount.

13. The EGR cooler mount of claim 1, further comprising a rail leak off passage being positioned in the EGR cooler mount and extending fluidly between a rail leak inlet port and a rail leak outlet port, the rail leak inlet port being positioned upstream of the rail leak outlet port, the rail leak inlet port being configured to receive leak off fuel from a common fuel rail, the rail leak outlet port opening out into the leak off passage, and the air bypass inlet port being positioned upstream of the rail leak outlet port.

14. The EGR cooler mount of claim 1, wherein the air bypass passage is a cross drilled passage in the EGR cooler mount.

15. The EGR cooler mount of claim 1, wherein the air bleed check valve and the air bypass passage are coaxially arranged relative to one another.

16. The EGR cooler mount of claim 1, wherein the air bleed check valve further comprises a ball and a spring, the ball is positioned between the spring and the air bypass inlet port, and an outer diameter of the ball is greater than an inner diameter of the air bypass inlet port.

17. An exhaust gas recirculation ("EGR") cooler mount, comprising:

a leak off passage being positioned in the EGR cooler mount and extending fluidly between an inlet port and an outlet port, the inlet port being configured to receive fuel, the outlet port being positioned downstream of the inlet port, the outlet port being configured to distribute the fuel;

an air bypass passage being positioned in the EGR cooler mount and extending fluidly between an air bypass inlet port and an air bypass outlet port, the air bypass inlet port being positioned upstream of the air bypass outlet port, the air bypass inlet port opening in from a fuel supply passage, and the air bypass outlet port opening out into the leak off passage; and an air bleed check valve, when in a closed position, being positioned against the air bypass inlet port and being configured to block communication between the air bypass passage and the leak off passage, and the air bleed check valve, when in an opened position, being positioned away from the air bypass inlet port and being configured to allow communication between the air bypass passage and the leak off passage.

18. An exhaust gas recirculation ("EGR") cooler mount, comprising:

a leak off passage being positioned in the EGR cooler mount and extending fluidly between an inlet port and an outlet port, the inlet port being configured to receive fuel, the outlet port being positioned downstream of the inlet port, the outlet port being configured to distribute the fuel; and an air bypass passage being positioned in the EGR cooler mount and extending fluidly between an air bypass inlet port and an air bypass outlet port, the air bypass inlet port being positioned upstream of the air bypass outlet port, the air bypass inlet port opening in from a fuel supply passage, and the air bypass outlet port opening out into the leak off passage.

* * * * *